US011766709B2

(12) United States Patent
Liasi et al.

(10) Patent No.: US 11,766,709 B2
(45) Date of Patent: Sep. 26, 2023

(54) FORMING DIE WITH REVERSE BEAD GEOMETRY

(71) Applicant: Ford Global Technologies, LLC, Dearborn, MI (US)

(72) Inventors: Evangelos Liasi, Royal Oak, MI (US); Liang Huang, Troy, MI (US); Feng Ren, West Bloomfield, MI (US); Andrey M. Ilinich, Novi, MI (US); Yuan Gan, Livonia, MI (US); S. George Luckey, Jr., Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 110 days.

(21) Appl. No.: 17/194,505

(22) Filed: Mar. 8, 2021

(65) Prior Publication Data

US 2022/0280994 A1 Sep. 8, 2022

(51) Int. Cl.
*B21D 24/04* (2006.01)
*B21D 37/10* (2006.01)

(52) U.S. Cl.
CPC ..... *B21D 37/10* (2013.01)

(58) Field of Classification Search
CPC ..... B21D 22/02; B21D 22/04; B21D 22/20; B21D 22/22; B21D 24/04; B21D 37/10; B21D 13/00; B21D 13/02
See application file for complete search history.

(56) References Cited

U.S. PATENT DOCUMENTS 3,664,172 A * 5/1972 Cvacho ..... B21D 22/22 413/8
4,195,510 A * 4/1980 Juergens ..... B21D 22/26 72/350
4,211,102 A * 7/1980 Hurvitz ..... B21D 49/00 72/312
4,531,395 A 7/1985 Dusman et al.
4,550,585 A * 11/1985 Sasaki ..... B21D 22/02 72/466
5,014,537 A * 5/1991 Nine ..... B21D 25/02 72/350

(Continued)

FOREIGN PATENT DOCUMENTS

CN 202263837 6/2012
CN 103341556 10/2013

(Continued)

*Primary Examiner* — Edward T Tolan
(74) *Attorney, Agent, or Firm* — Burris Law, PLLC

(57) ABSTRACT

A forming die includes a first die component with a male bead and a second die component with a female bead. The male bead and the female bead form a bead with a reverse bead geometry with the male bead having a groove and the female bead having a protrusion complimentary with the groove such that the protrusion is aligned with the groove when the male bead extends into the female bead. The male bead includes a push surface, a pair of sidewalls extending from the push surface to a main surface of the first die component, and the groove extends inwardly into the rib. And the female bead includes a stop surface and a pair of sidewalls extending from the stop surface to a main surface of the second die component, and the protrusion extends outwardly from the stop surface into the female bead.

20 Claims, 6 Drawing Sheets

(56) References Cited

U.S. PATENT DOCUMENTS

| | | | | |
|---|---|---|---|---|
| 5,381,683 | A * | 1/1995 | Cowling | B21D 51/44 72/348 |
| 5,533,372 | A * | 7/1996 | Roper | B21D 26/021 72/63 |
| 6,079,249 | A * | 6/2000 | Turner | B21D 13/02 72/348 |
| 6,196,043 | B1 * | 3/2001 | Ehardt | B21D 22/22 72/350 |
| 7,320,239 | B1 * | 1/2008 | Kruger | B21D 26/057 72/60 |
| 8,831,914 | B2 | 9/2014 | Shen et al. | |
| 9,120,137 | B2 | 9/2015 | Zhou et al. | |
| 9,662,700 | B2 * | 5/2017 | Taguchi | H01M 8/0206 |
| 10,052,673 | B2 | 8/2018 | Huang et al. | |
| 2008/0127706 | A1 * | 6/2008 | Baker | B21D 5/01 72/379.6 |
| 2008/0264138 | A1 * | 10/2008 | Woo | B21D 22/02 72/414 |
| 2010/0133724 | A1 * | 6/2010 | Flehmig | B21D 22/21 264/294 |
| 2011/0094283 | A1 * | 4/2011 | Flehmig | B21D 22/22 72/347 |
| 2013/0074425 | A1 * | 3/2013 | Miyamoto | E04F 13/0892 52/126.7 |

FOREIGN PATENT DOCUMENTS

| | | | |
|---|---|---|---|
| CN | 103418659 | | 12/2013 |
| DE | 102012014201 | | 8/2013 |
| DE | 102015220231 | A1 * | 4/2017 |
| JP | 2004150490 | | 5/2004 |
| JP | 2004154786 | | 6/2004 |
| KR | 98078401 | A * | 11/1998 |
| KR | 101665796 | | 10/2016 |

* cited by examiner

FORMING DIE WITH REVERSE BEAD GEOMETRY

FIELD

The present disclosure relates to forming dies and particularly to forming dies with a bead.

BACKGROUND

The statements in this section merely provide background information related to the present disclosure and may not constitute prior art.

A "bead" of a forming die is a design feature that functions to control metal flow of a panel being deformed during a forming operation. Particularly, the bead enhances "panel stretch" of the panel during a forming operation and thereby enhances panel quality for attributes such as dent resistance, dimensional stability and surface appearance.

Traditional beads have a female bead portion (referred to herein simply as a "female bead") and a complimentary male bead portion (referred to herein simply as a "male bead") such that the panel flows into the female bead and around the male bead during the forming operation. Also, depth of the female bead, and radii of both the female bead and the male bead, are geometric parameters that set or control a restraining force on the panel during the forming operation. Particularly, increasing the depth of the female die and/or decreasing the radii of the female and male dies increases the restraining force on a panel during a forming operation. However, the thickness and mechanical properties of the panel limit the depth of the female bead and the radii of the female and male dies. Accordingly, forming dies with "double beads" are used to provide such desired restraining forces.

The present disclosure addresses the issues of forming dies with beads among other issues related to forming dies.

SUMMARY

This section provides a general summary of the disclosure and is not a comprehensive disclosure of its full scope or all of its features.

In one form of the present disclosure, a forming die includes a first die component with a male bead and a second die component with a female bead. The male bead and the female bead form a bead with a reverse bead geometry with the male bead having a groove and the female bead having a protrusion complimentary with the groove such that the protrusion is aligned with the groove when the male bead extends into the female bead.

In some variations, the male bead includes a push surface, a pair of sidewalls extending from the push surface to a main surface of the first die component, and the groove extends inwardly into the rib.

In at least one variation, the female bead includes a stop surface and a pair of sidewalls extending from the stop surface to a main surface of the second die component. In such variations the protrusion extends outwardly from the stop surface into the female bead.

In some variations, the protrusion extends at least partially into the groove when the male bead extends into the female bead during a forming operation.

In at least one variation, the protrusion is integral with the second die component, while in other variations the protrusion is an insert seated within the female bead, and in some variations, the insert is a replaceable insert. For example, in at least one variation the second die component includes an insert channel extending from the female bead into the second die component and the insert is seated within the insert channel. And in some variations a shim is included and positioned between the insert and the insert channel. In at least one variation the shim is between an inner surface of the insert and an outer surface of the insert channel and may or may not be a polymer foam shim.

In some variations, the second die component includes a binder perimeter, the female bead extends along an entire length of the binder perimeter, and the protrusion extends along the entire length of the binder perimeter. In other variations, the second die component includes a binder perimeter, the female bead extends along an entire length of the binder perimeter, and the protrusion extends along discrete sections of the binder perimeter. Also, a plurality of shims can be positioned between the plurality of inserts and the insert channel. In some variations, at least two of the plurality of shims have a different thickness.

In another form of the present disclosure a forming die includes a first die component with a male bead having a push surface and a groove extending inwardly from the push surface, and a second die component with a female bead having a stop surface and a protrusion extending outwardly from the stop surface. In some variations, the protrusion is complimentary and aligned with the groove when the male bead extends into the female bead during a forming operation.

In at least one variation, the second die component includes an insert channel extending from the female bead into the second die component, the protrusion is an insert seated within the insert channel, and a shim is positioned between the insert and the insert channel. And in some variations, the protrusion includes a plurality of inserts seated within the insert channel, a plurality of shims positioned between the plurality of inserts and the insert channel, and at least two of the plurality of shims have a different thickness.

In still another form of the present disclosure, a forming die includes a first die component with a male bead having a push surface and a groove extending inwardly from the push surface, a second die component with a female bead having a stop surface and an insert channel, and a plurality of inserts seated within the insert channel. In some variations, the plurality of inserts include a protrusion that is complimentary and aligned with the groove when the male bead extends into the female bead during a drawing operation.

In at least one variation, a plurality of shims are positioned between the plurality of inserts and the insert channel and at least two of the plurality of shims have a different thickness.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
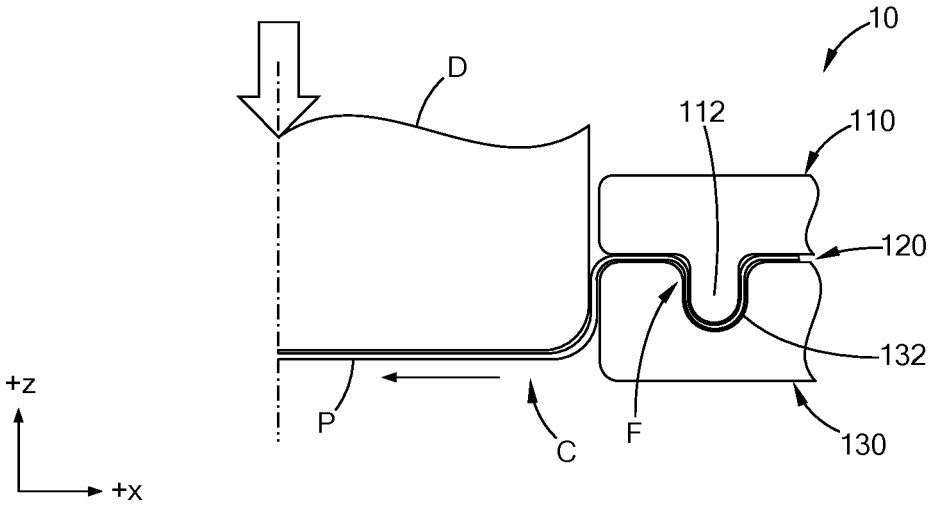
FIG. 1 (Prior Art)
FIG. 1 is a side cross-sectional view (without cross-hatching) of a forming die with a bead according to the teachings of the prior art.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

A forming die with a bead having a reverse bead geometry that provides enhanced restraining capability is provided. As used herein, the phrase "reverse bead geometry" refers to a portion of a bead having a geometry that is reversed (e.g., 180 degrees rotated) from a geometry of the bead. Also, non-limiting examples of forming dies include bending dies, stretching dies, and drawing dies, among others.

Referring to FIG. 1, one example of a traditional forming die 10 with a first die component 110 having a male bead 112 and a second die component 130 having a female bead 132 is shown. The male bead 112 and the female bead 132 form a bead 120. When the first die component 110 is spaced apart (z direction) from the second die component 130 a panel P is positioned between the first and second die component 110, 130 (e.g., on the second die component 130) such that the panel extends across a forming cavity 'C'. And when the panel P is in a desired position the first die component 110 is moved downwardly (−z direction) and into contact with the panel P such that a flange or bead section of the panel P is positioned and held between the first die component 110 and the second die component 130 as shown in FIG. 1. Particularly, a portion of the panel P is positioned between the male bead 112 and the female bead 132. Then, a punch die D is moved into the forming cavity such the panel P is formed into forming cavity C.

During forming of the panel P into the forming cavity C, the panel P extending beyond (+x direction) the bead 120 is pulled (−x direction) into the female bead 132, pulled or bent around the male bead 112, and then re-straightened upon exiting the female bead 132. It should be understood that bending of the panel P around the male bead 112 and straightening of the panel P as it exits the female bead 132 (−x direction) provides a restraining force to enhance panel stretch during the forming operation. However, and as noted above, traditional forming dies with a single bead may not provide sufficient restraining force during a forming operation depending on factors such as the material of the panel P, properties of the material from which the panel P is made from, a thickness of the panel P, and a lubricant used during the forming operation, among others. Accordingly, some traditional forming dies use "double beads" (i.e., two beads next to each other) to provide desired restraining forces. However, the use of such double beads requires additional panel material, i.e., additional flange section material, during the forming operation, thereby increasing the cost of manufacture.

Figure 2:
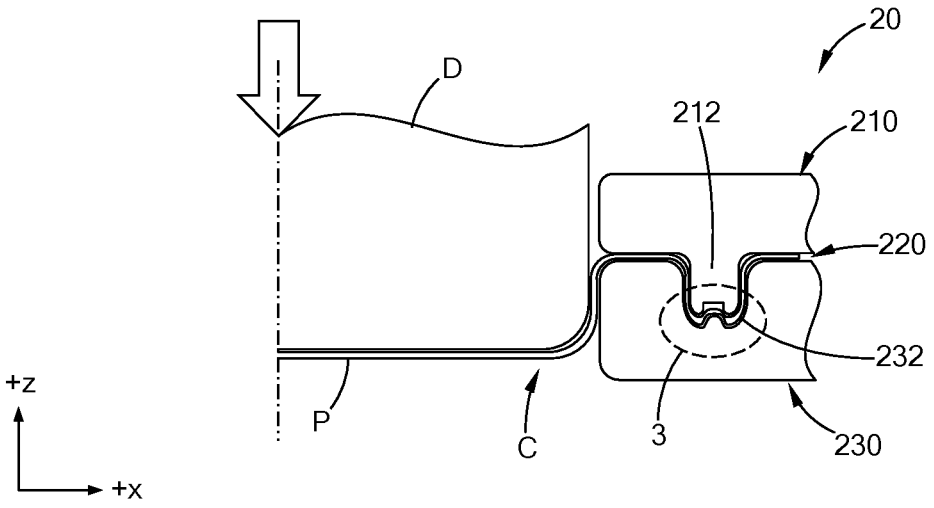
FIG. 2 is a side cross-sectional view (without cross-hatching) of a forming die with a bead according to the teachings of the present disclosure.
Figure 3:
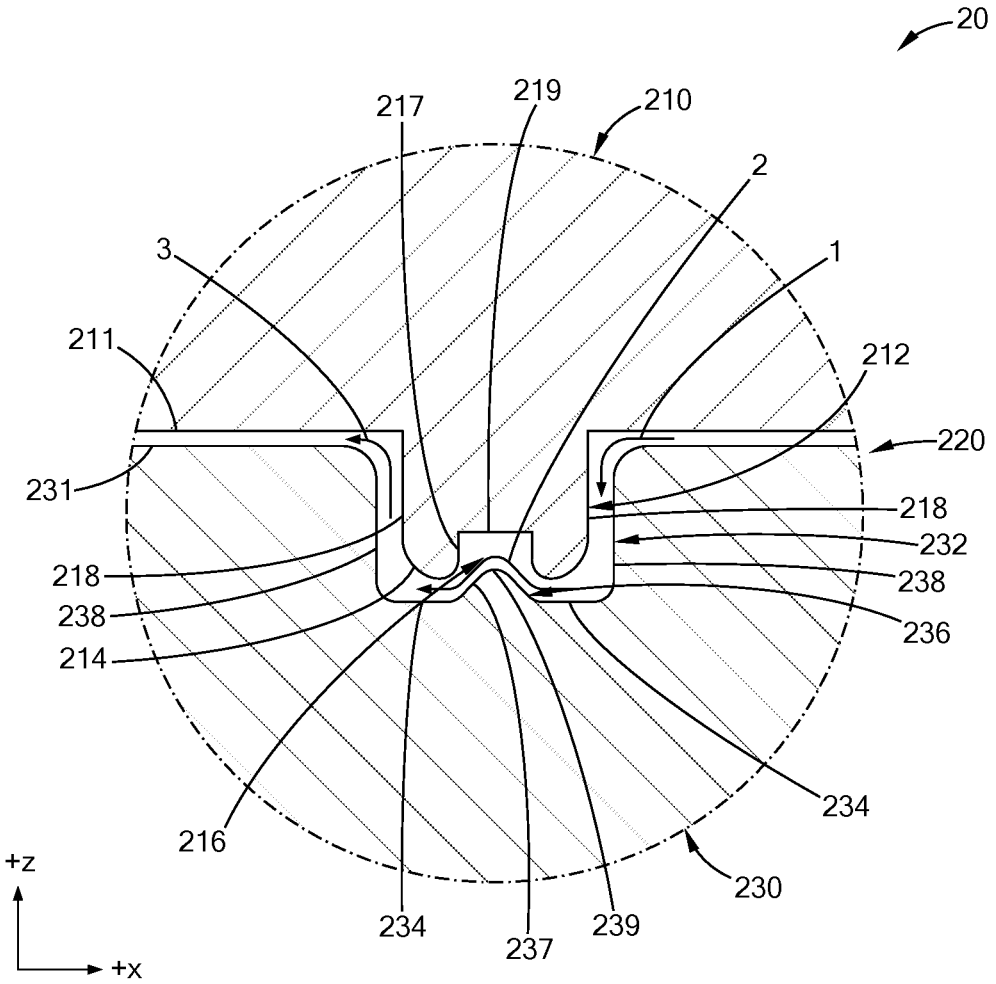
FIG. 3 is an enlarged view of section '3' in FIG. 2.

Referring now to FIGS. 2 and 3, a forming die 20 with a bead 220 having a reverse bead geometry according to one form of the present disclosure is shown in FIG. 2 and an enlarged view of the bead 220 is shown in FIG. 3. The forming die 20 with the bead 220 includes a first die component 210 with a male bead 212 and a second die component 230 with a female bead 232. The male bead 212 has a groove 216 (FIG. 3) and the female bead 232 has a protrusion 236. In some variations the protrusion 236 is complimentary with the groove 216 such that the protrusion 236 is aligned (x direction) with the groove 216 when the male bead 212 extends into the female bead 232 as shown in FIGS. 2 and 3.

In at least one variation, the male bead 212 includes a push surface 214 and a pair of male bead sidewalls 218 (also referred to herein simply as "a pair of sidewalls 218" or "sidewalls 218") extending from the push surface 214 to a main surface 211 of the first die component 210. Also, the groove 216 extends inwardly (+z direction) into the male bead 212. In some variations, the groove 216 is defined by at least one groove sidewall 217 and a groove root 219 as shown in FIG. 3.

In some variations, the female bead 232 includes a stop surface 234 and a pair of female bead sidewalls 238 (also referred to herein simply as "a pair of sidewalls 238" or "sidewalls 238") extending from the stop surface 234 to a main surface 231 of the second die component 230. Also the protrusion 236 extends outwardly (+z direction) from the stop surface 234 into the female bead 232. In at least one variation, the protrusion 236 is defined by at least one protrusion sidewall 237 and a protrusion crown 239 as shown in FIG. 3.

As shown in FIG. 3, in some variations the protrusion 236 extends at least partially into the groove 216 when the male bead 212 extends into the female bead 232, e.g., during a forming operation. And in at least one variation, the protrusion 236 is integral with the second die component 230, i.e., the second die component 230 and the protrusion 236 is/are a single component.

It should be understood that during a forming operation of the panel P (shown in FIG. 1 but not in FIG. 3 for clarity), the portion or section of the panel P beyond (+x direction) the bead 220 slides into the female bead 232 between the outer (+x direction) sidewalls 218, 238 as indicated by arrow 1, into and out of the groove 216 by sliding over the protrusion 236 as indicated by arrow 2, and out of the female bead 232 between the inner (−x direction) sidewalls 218, 238 as indicated by arrow 3. It should also be understood that bending of the panel P around the protrusion 236 and straightening of the panel P along the inner (−x direction) sidewalls 218, 235 increases the restraining force on the panel P during a forming operation compared to the traditional forming die 10 with the bead 120 shown in FIG. 1. Accordingly, the bead 220 with the reverse bead geometry provides an enhanced panel stretch during forming of the panel P without the use of a double bead.

Figure 4:
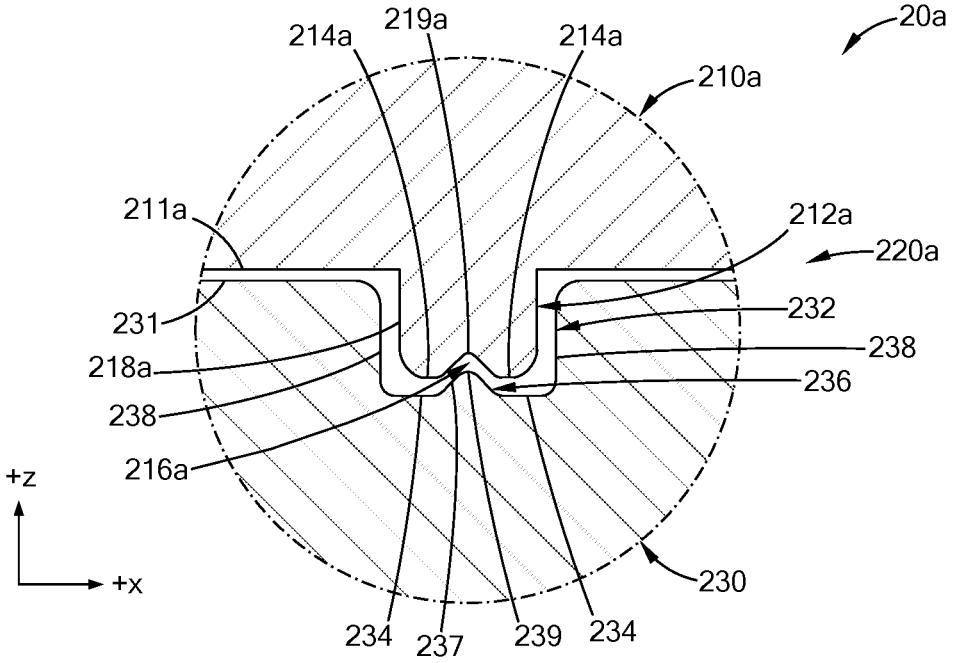
FIG. 4 is an enlarged cross-sectional view of the bead in FIG. 2 according to another form of the present disclosure.

Referring now to FIG. 4, a forming die 20*a* with a bead 220*a* having a reverse bead geometry according to another form of the present disclosure is shown. The forming die 20*a* with the bead 220*a* includes a first die component 210*a* with a male bead 212*a* and the second die component 230 with the female bead 232. The male bead 212*a* has a groove 216*a* and the female bead 232 has the protrusion 236. In some variations the protrusion 236 is complimentary with the groove 216*a* such that the protrusion 236 is aligned (x direction) with the groove 216*a* when the male bead 212*a* extends into the female bead 232 as shown in FIG. 4.

In some variations, the male bead 212*a* includes a push surface 214*a* and a pair of male bead sidewalls 218*a* extending from the push surface 214*a* to a main surface 211*a* of the first die component 210. Also, the groove 216*a* extends inwardly (+z direction) into the male bead 212*a*. In at least one variation, the groove 216*a* is defined by at least one groove sidewall 217*a* and a groove root 219*a* as shown in FIG. 4. Also, in some variations the protrusion 236 extends at least partially into the groove 216*a* when the male bead 212*a* extends into the female bead 232, e.g., during a forming operation.

Figure 5:
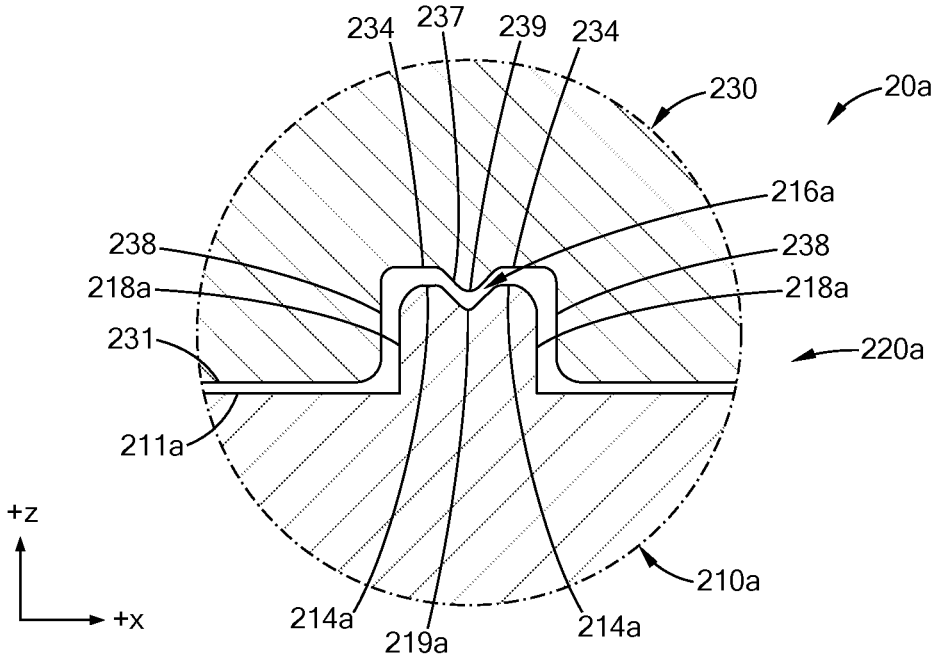
FIG. 5 is a cross-sectional view of the bead in FIG. 4 with a different orientation.

While FIGS. 3 and 4 show the first die components 210, 210*a* as being an upper (+z direction) die component and the second die component 230 as a lower (−z direction) die component, it should be understood that at least one other orientation of first and second die components is included within the teachings of the present disclosure. For example, and with reference to FIG. 5, the forming die 20*a* is shown with the first die component 210*a* being a lower (−z direction) die component and the second die component 230 being an upper (+z direction) die component.

Figure 6:
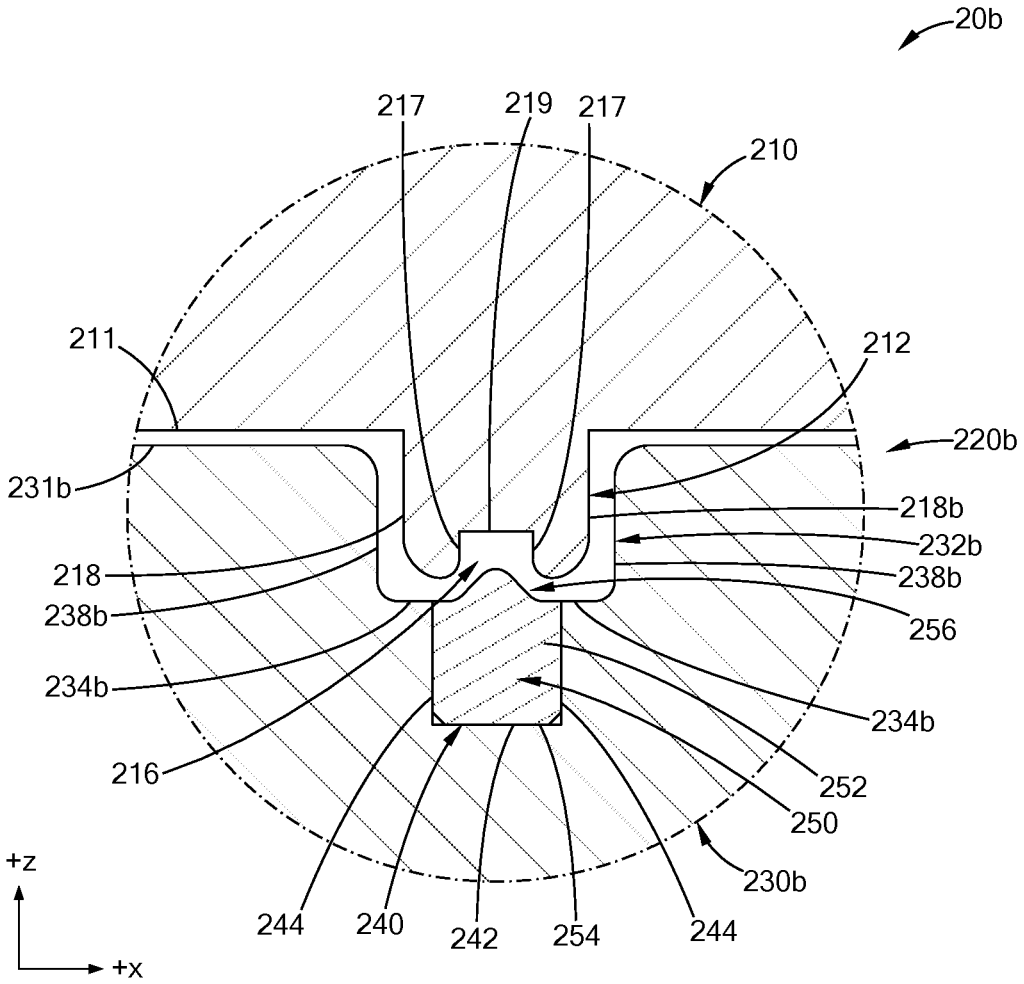
FIG. 6 is an enlarged cross-sectional view of the bead in FIG. 2 according to yet another form of the present disclosure.

Referring to FIG. 6, a forming die 20*b* with a bead 220*b* having a reverse bead geometry according to still another form of the present disclosure is shown. The forming die 20*b* with the bead 220*b* includes the first die component 210 with the male bead 212 and a second die component 230*b* with a female bead 232*b*. The male bead 212 has the groove 216. However, and unlike the protrusion 236 shown in FIGS. 3 and 4, an insert 250 comprises a protrusion 256. Particularly, the second die component 230*b* includes an insert channel 240 configured to accept the insert 250. In some variations, the insert channel 240 has a bottom (−z direction) wall 242 and a pair of insert channel sidewalls 244 extending from the bottom wall 242 to a stop surface 234*b* of the female bead 232*b*. And the insert 250 includes a body 252 with a complimentary bottom surface (not labeled, complimentary with bottom wall 242), and complimentary sidewalls (not labeled, complimentary with insert channel sidewalls 244). As shown in FIG. 6, the protrusion 256 extends outwardly (+z direction) from the body 252 and into the female bead 232*b*.

In some variations the protrusion 256 is complimentary with the groove 216 such that the protrusion 256 is aligned (x direction) with the groove 216 when the male bead 212 extends into the female bead 232*b* as shown in FIG. 6. Also, in some variations the protrusion 256 extends at least partially into the groove 216 when the male bead 212 extends into the female bead 232*b*, e.g., during a forming operation.

It should be understood that the insert 250 provides for flexibility in the size and shape of the reverse bead geometry of the bead 220*b*. And in some variations the insert 250, and other inserts disclosed herein, provide for enhanced maintenance and repair of forming dies. In at least one variation, inserts 250 with different shaped or sized protrusions 256 are used for forming of panels P with different properties (e.g., different thicknesses). For example, one insert 250 (or a set of inserts 250) with a given sized and/or shaped protrusion 256 is used for forming one or more panels P having a first thickness (z direction), and then removed and replaced with another insert 250 (or another set of inserts 25) with a different sized and/or shaped protrusion 256 for forming one or more panels P having a second thickness different than the first thickness. In the alternative, or in addition to, one insert 250 (or a set of inserts 250) can be used for forming a plurality of panels P until the protrusion 256 is "worn" by a predefined amount and then removed and replaced with a new or reconditioned insert 250 (or new or recondition set of inserts 250). In this manner, routine maintenance (e.g., removal and repair or replacement) of the second die component 230*b*, and cost of a forming campaign, is reduced.

Figure 7:
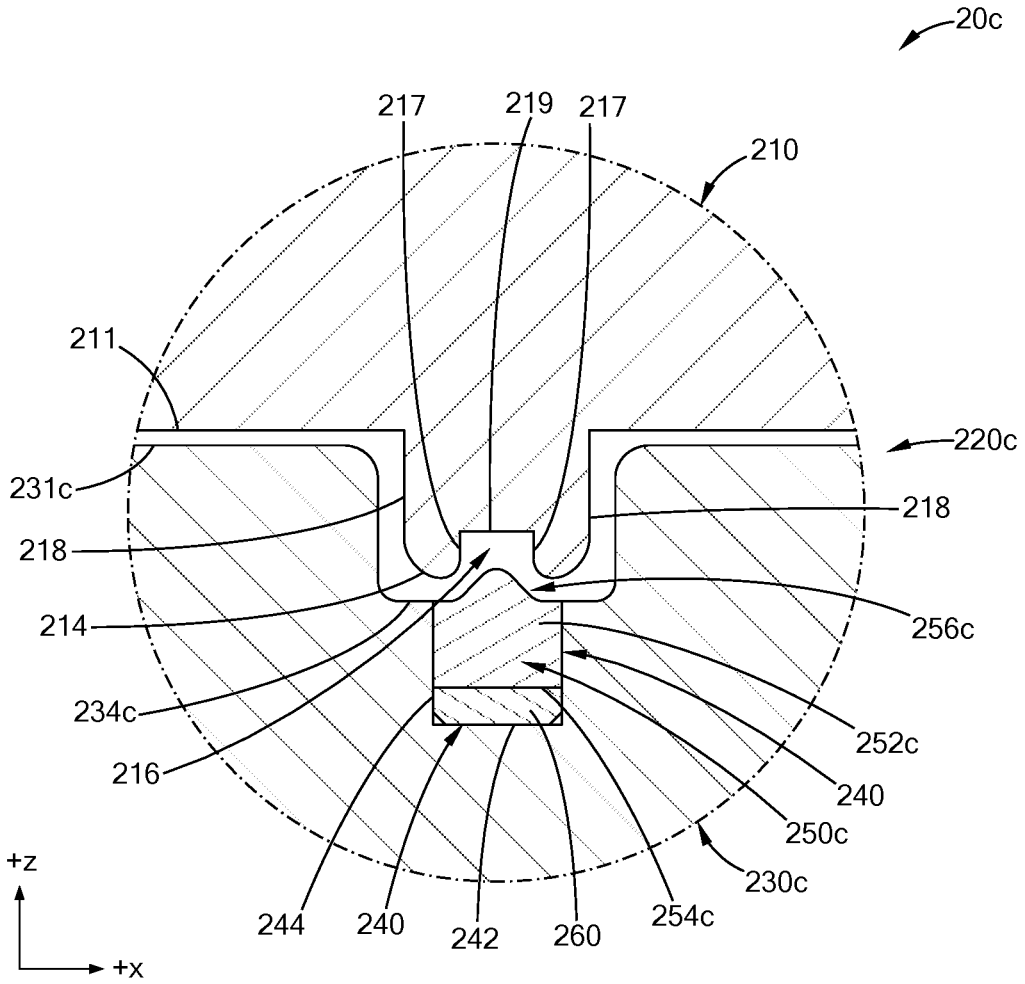
FIG. 7 is an enlarged cross-sectional view of the bead in FIG. 2 according to still yet another form of the present disclosure.

Referring to FIG. 7, a forming die 20*c* with a bead 220*c* having a reverse bead geometry according to still yet another form of the present disclosure is shown. The forming die 20*c* with the bead 220*c* includes the first die component 210 with the male bead 212 and the second die component 230*b* with the female bead 232*b*. The male bead 212 has the groove 216. Also, a shim 260 is included and positioned between an insert 250*c* (with a protrusion 256*c*) and the bottom wall 242 of the insert channel 240. In some variations, a shim 260 with a predetermined thickness (z direction) is selected and used such that the protrusion 256*c* extends into the female bead 232*b* a predefined and desired distance or amount. And in at least one variation, the shim 260 is elastically deformable such that the shim 260 provides or applies an upward (+z direction) force on the insert 250*c* during a forming operation. One non-limiting example of an elastically deformable shim is a polymer foam shim.

In some variations the protrusion 256*c* is complimentary with the groove 216 such that the protrusion 256*c* is aligned (x direction) with the groove 216 when the male bead 212 extends into the female bead 232*b* as shown in FIG. 7. Also, in some variations the protrusion 256*c* extends at least partially into the groove 216 when the male bead 212 extends into the female bead 232*b*, e.g., during a forming operation. In addition, it should be understood that the shim 260 provides for flexibility in maintenance and repair of forming dies. For example, in at least one variation, shims 260 with different thicknesses are used depending on the size of thickness of the insert 250*c* after repair or reconditioning.

Figure 8:
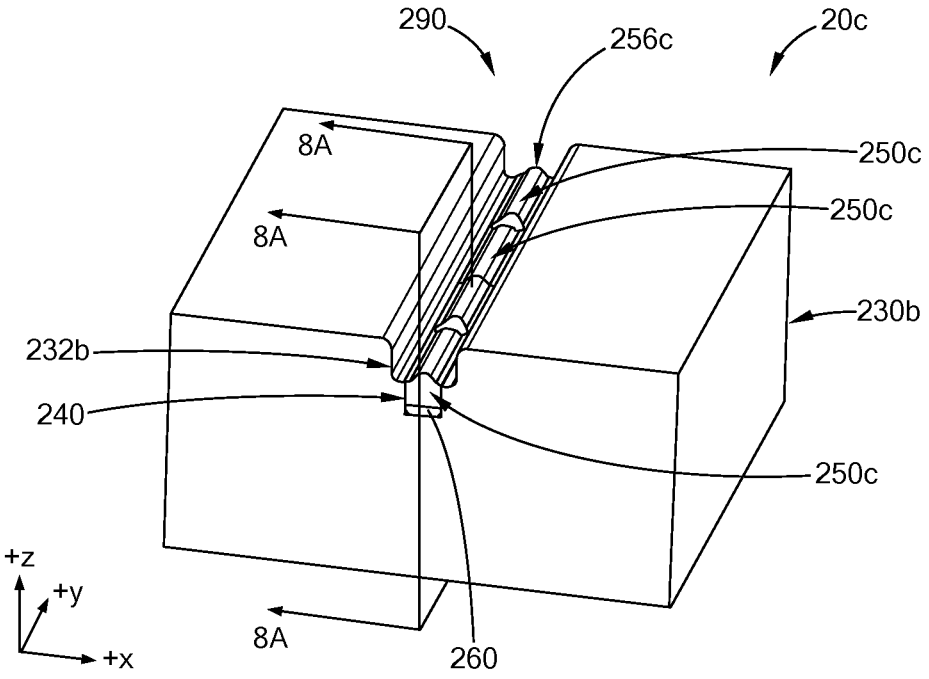
FIG. 8 is a perspective view of a female bead with a plurality of protrusion inserts according to one form of the present disclosure.
Figure 8A:
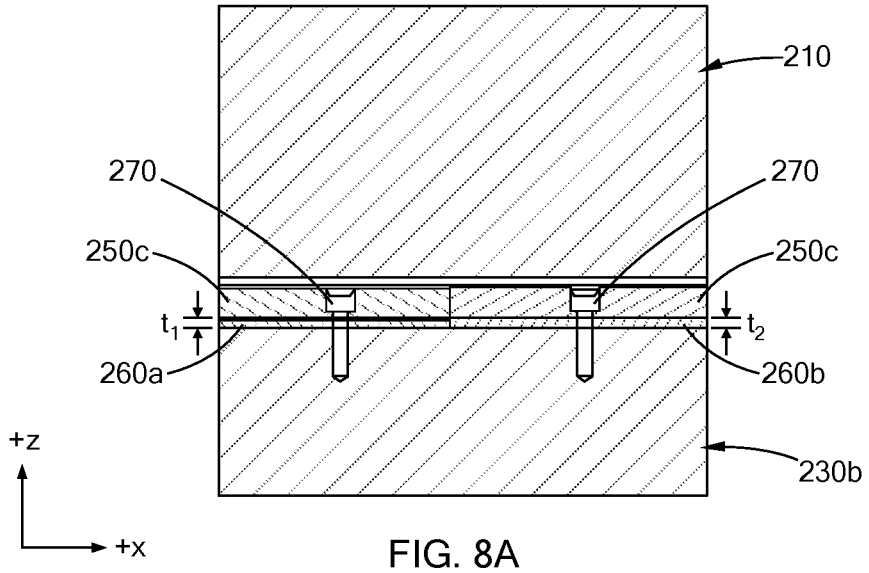
FIG. 8A is a cross-sectional view of section 8A-8A in FIG. 8.

For example, and with reference to FIGS. 8 and 8A, the second die component 230*b* with the female bead 232*b* is shown with a plurality of inserts 250*c* positioned within an insert channel 240 extending along a length (y direction) of the female bead 232*b*. Stated differently the female bead 232*b* can be part of a binder perimeter 290 and the plurality of inserts 250*c* can extend along an entire length of the binder perimeter 290.

In addition, FIG. 8A shows that a first shim 260*a* has a first thickness TV and a second shim 260*b* has a second thickness 't2' that is greater than t1. Accordingly, the shims 260*a*, 260*b* compensate for inserts 250*c* with different thicknesses and/or adjusting or providing a different height (z direction) for different protrusions 256*c* such that the restraining force during forming of the panel P can be adjusted as a function of the position or section of the panel P relative to the different protrusions 256*c*.

In some variations, only a portion of the female bead 232*b* includes or has the plurality of inserts 250*c*. That is, a first portion (not shown) of the female bead 232*b* has one or more inserts 250*c* and a second portion of the female bead 232*b* does not have an insert 250*c* such that the restraining force along a length of the female bead 232*b* varies as desired. Stated differently, in at least one variation the female bead 232*b* extends along the binder perimeter 290 and the inserts

250*c* (and the corresponding protrusions 256*c*) extend along discrete sections of the binder perimeter 290.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A forming die comprising:

a first die component comprising a main surface and a male bead, the male bead comprising a push surface; and a second die component comprising a main surface extending in a first direction and a female bead having sidewalls extending in a second direction perpendicular to the first direction, wherein the male bead comprises a groove extending inwardly into the male bead from the push surface less than an entire distance between the push surface and the main surface and the female bead comprises a protrusion extending toward the groove of the male bead such that the protrusion is aligned with the groove when the male bead extends into the female bead in the second direction.

2. The forming die according to claim 1, wherein the male bead comprises a pair of sidewalls extending from the push surface to the main surface of the first die component.

3. The forming die according to claim 1, wherein the female bead comprises a stop surface and the sidewalls are a pair of sidewalls extending from the stop surface to the main surface of the second die component, and the protrusion extends outwardly from the stop surface into the female bead.

4. The forming die according to claim 1, wherein the protrusion extends at least partially into the groove when the male bead extends into the female bead during a forming operation, the first die component and the second die component being configured to be movable toward or away from each other in a same direction in which the sidewalls of the female bead extend.

5. The forming die according to claim 1, wherein the protrusion is integral with the second die component.

6. The forming die according to claim 1, wherein the protrusion is an insert seated within the female bead.

7. The forming die according to claim 6, wherein the insert is a replaceable insert.

8. The forming die according to claim 6, wherein the second die component comprises an insert channel extending from the female bead into the second die component, and the insert is seated within the insert channel.

9. The forming die according to claim 8 further comprising a shim between the insert and the insert channel.

10. The forming die according to claim 9, wherein the shim is between an inner surface of the insert and an outer surface of the insert channel.

11. The forming die according to claim 9, wherein the shim is a polymer foam shim.

12. The forming die according to claim 9, wherein the insert is a plurality of inserts seated within the insert grove and the shim is a plurality of shims positioned between the plurality of inserts and the insert channel.

13. The forming die according to claim 12, wherein at least two of the plurality of shims have a different thickness.

14. The forming die according to claim 1, wherein the second die component comprises a binder perimeter, the female bead extends along an entire length of the binder perimeter, and the protrusion extends along the entire length of the binder perimeter.

15. The forming die according to claim 1, wherein the second die component comprises a binder perimeter, the female bead extends along an entire length of the binder perimeter, and the protrusion extends along discrete sections of the binder perimeter.

16. A forming die comprising:

a first die component comprising a main surface and a male bead, the male bead comprising a push surface and a groove extending inwardly into the male bead from the push surface less than an entire distance between the push surface and the main surface; and a second die component comprising a main surface extending in a first direction and a female bead comprising a stop surface, sidewalls extending in a second direction perpendicular to the first direction, and a protrusion extending outwardly from the stop surface, wherein the protrusion is aligned with the groove when the male bead extends into the female bead in the second direction during a forming operation.

17. The forming die according to claim 16, wherein the second die component comprises an insert channel extending from the female bead into the second die component, the protrusion is an insert seated within the insert channel, and a shim is between the insert and the insert channel.

18. The forming die according to claim 17, wherein the protrusion comprises a plurality of inserts seated within the insert channel, a plurality of shims positioned between the plurality of inserts and the insert channel, and at least two of the plurality of shims have a different thickness.

19. A forming die comprising:

a first die component comprising a main surface and a male bead, the male bead comprising a push surface and a groove extending inwardly into the male bead from the push surface less than an entire distance between the push surface and the main surface;

a second die component comprising a main surface extending in a first direction and a female bead comprising a stop surface, sidewalls extending in a second direction perpendicular to the first direction, and an insert channel; and a plurality of inserts seated within the insert channel, wherein the plurality of inserts comprise a protrusion aligned with the groove when the male bead extends into the female bead in the second direction during a drawing operation.

20. The forming die according to claim 19 further comprising a plurality of shims positioned between the plurality of inserts and the insert channel, wherein at least two of the plurality of shims have a different thickness.

* * * * *